US006758757B2

(12) United States Patent
Luciano, Jr. et al.

(10) Patent No.: US 6,758,757 B2
(45) Date of Patent: Jul. 6, 2004

(54) METHOD AND APPARATUS FOR MAINTAINING GAME STATE

(75) Inventors: Robert Anthony Luciano, Jr., Reno, NV (US); Robert William Crowder, Las Vegas, NV (US); Russ Frederick Marsden, Gardnerville, NV (US)

(73) Assignee: Sierra Design Group, Reno, NV (US)

( * ) Notice: Subject to any disclaimer, the term of this patent is extended or adjusted under 35 U.S.C. 154(b) by 0 days.

(21) Appl. No.: 09/788,168

(22) Filed: Feb. 15, 2001

(65) Prior Publication Data

US 2002/0094871 A1 Jul. 18, 2002

Related U.S. Application Data

(63) Continuation of application No. 09/742,679, filed on Dec. 20, 2000.

(51) Int. Cl.[7] ..... A63F 5/00

(52) U.S. Cl. ..... 463/43; 463/29; 463/42; 463/16; 463/20; 463/24

(58) Field of Search ..... 463/16–29, 42–43, 463/11; 705/14; 235/379; 273/460, 139, 461

(56) References Cited

U.S. PATENT DOCUMENTS

| | | | | | |
|---|---|---|---|---|---|
| 4,342,454 | A | | 8/1982 | Baer et al. | |
| 4,752,068 | A | * | 6/1988 | Endo | 463/15 |
| 4,764,666 | A | * | 8/1988 | Bergeron | 463/25 |
| 4,858,930 | A | * | 8/1989 | Sato | 463/23 |
| 4,882,473 | A | * | 11/1989 | Bergeron et al. | 463/25 |
| 4,948,138 | A | | 8/1990 | Pease et al. | |
| 5,018,736 | A | * | 5/1991 | Pearson et al. | 463/29 |
| 5,179,517 | A | | 1/1993 | Sarbin et al. | |
| 5,370,399 | A | | 12/1994 | Liverance | |
| 5,429,361 | A | | 7/1995 | Raven et al. | |
| 5,470,079 | A | | 11/1995 | LeStrange et al. | |
| 5,547,202 | A | * | 8/1996 | Tsumura | 463/29 |
| 5,586,766 | A | | 12/1996 | Forte et al. | |
| 5,586,936 | A | * | 12/1996 | Bennett et al. | 463/25 |
| 5,655,961 | A | * | 8/1997 | Acres et al. | 463/27 |
| 5,743,800 | A | | 4/1998 | Huard et al. | |
| 5,882,258 | A | * | 3/1999 | Kelly et al. | 463/11 |
| 5,983,196 | A | * | 11/1999 | Wendkos | 705/14 |
| 5,997,401 | A | | 12/1999 | Crawford | |
| 6,007,426 | A | * | 12/1999 | Kelly et al. | 463/16 |
| 6,009,412 | A | * | 12/1999 | Storey | 705/14 |
| 6,015,344 | A | * | 1/2000 | Kelly et al. | 463/16 |
| 6,048,269 | A | * | 4/2000 | Burns et al. | 463/25 |
| 6,061,660 | A | * | 5/2000 | Eggleston et al. | 705/14 |
| 6,165,071 | A | | 12/2000 | Weiss | |
| 6,178,408 | B1 | * | 1/2001 | Copple et al. | 705/14 |
| 6,179,710 | B1 | | 1/2001 | Sawyer et al. | |
| 6,193,608 | B1 | * | 2/2001 | Walker et al. | 463/25 |
| 6,203,430 | B1 | | 3/2001 | Walker et al. | |
| 6,280,326 | B1 | * | 8/2001 | Saunders | 235/379 |

* cited by examiner

*Primary Examiner*—Teresa Walberg
*Assistant Examiner*—Yveste Cherubin
(74) *Attorney, Agent, or Firm*—Russ F. Marsden

(57) ABSTRACT

A system and method for maintaining player's game state (award credits, partial award states, and non-award or non-credit states) in a gaming environment is disclosed. In particular, the player may restore the game state from previously played games either from the same game device or from another game device. The invention also provides for award redemption of the award credits (or game pieces) earned by a player during game play.

18 Claims, 15 Drawing Sheets

Example Award Credit System

Meta-Games According To
The Present Invention

Award Credit Accounting
With Back End Validation Device

Gaming Device And Prize Station On One Physical Machine

Award Credits On Multiple Machines

Award Credits In A Networked Environment

Gaming Device Details

Prize Station Device Details

Further Meta-Game Examples

Hierarchical Prize Levels

The value of a prize at any level is deemed to be one-half the value of the prizes one level above itself and twice the value of the prizes one level below itself.

Game State Saving Game
With Credits

Game State Saving Game
With Skill Points

General Bearer Instrument (GBI) Service Station

Example Use Of GBI Service Station

METHOD AND APPARATUS FOR MAINTAINING GAME STATE

RELATED APPLICATIONS

This application is a continuation in part of co-pending application Ser. No. 09/742,679 filed Dec. 20, 2000, Attorney Docket No. GSS-00-001.

BACKGROUND OF THE INVENTION

1. Field of the Invention

This invention pertains generally to gaming systems. More particularly, the present invention relates to a method and apparatus for maintaining game state spanning periods when a player is not at a particular game, when a player switches play from one machine to another, and similar situations.

2. The Prior Art

Gaming devices of various types have been in use for many years. The most common type is the conventional slot. A player operates a slot machine by providing coin or paper monies that are received as game credits towards playing a game on the slot machine. Some machines allow a user to provide game credits in the form of a voucher, a printed coupon or a data card (e.g. magnetic strip or smart card). Once the sufficient amount of game credits has been provided to constitute a wager, the player then initiates the game, normally by pulling a handle or activating a button. If a winning event occurs, where a winning event is defined by the game being played, the slot machine issues a winning amount according to the player's wager and to a predetermined pay scheme. The game results are generally based on randomly generated events. The winning amount issued to the user is provided by a corresponding amount of game credits, which the player may redeem (cash-out) or use for further play on the slot machine. Similar game play and award schemes are provided according to other gaming devices such as video poker machines and keno machines.

Bonus and progressive awards have been introduced as improvements to conventional gaming devices to entice increased game play. A common bonus scheme is to award a player a chance to multiply the player's award winnings on a secondary or bonus stage of the game. Most bonus awards are simply an increased multiple of the primary winnings and are issued as game credits suitable for redemption or further play of the gaming device currently being played. In certain cases where the bonus award is large, manual payout by a casino attendant may be required. In some cases a non-monetary prize (e.g., a car) is made the subject of the bonus award. Like the larger monetary progressive awards, these non-monetary prizes are normally tendered manually by a casino attendant.

Progressive awards, like bonus awards, also normally comprise simple monetary credits, but typically comprise a large jackpot amount. Progressive awards couple more than one gaming machine, where some amount of the money a player spends at each gaming machine goes into a central award or "pot". The players of each coupled machine compete for the progressive award. The overall result is that a significantly larger award can be won by a player playing progressive games at a coupled machine than can be won at an individual gaming machine. Upon the occurrence of a specific game result, the progressive award is issued to the player. Since the progressive award is normally large, it is normally paid manually by a casino attendant or cashier.

Another prior art gaming implementation is known as "investment bonus". An example of this type of game is the 1937 Mills "Bonus Bell" game which provides a primary slot reel game, and a secondary investment bonus game (or "come-on" feature). During play the word "BONUS" could be spelled out by hitting the correct letters in sequence on the first reel for an eighteen (18) coin award. This type of game is generally referred to as an "investment bonus" game, because the player invests in continued play of the same machine to achieve the requirements for the bonus award (e.g., in the Mills' game completing the word "BONUS"). If the player were to terminate play of the investment game prior to completing the requirements for the bonus award (e.g., the player only completes "BON"), the player normally forfeits the player's prior investments ("BON") and must later fulfill the requirements anew. Furthermore, a subsequent player may "take over" a previous player's investment by commencing play of the investment bonus game after the previous player vacates the machine.

Current gaming devices and methods, while suitable for normal award credit payout and one-time non-monetary prize payout, have some particular disadvantages. First, current gaming schemes are not well suited for awarding prizes having a hierarchical arrangement which require a player to collect two or more "winning events" towards the redemption of an award. This is especially true where the winning events may be derived from two or more gaming machines. For example, in conventional bonus, secondary, or investment bonus games, the player may accumulate points towards redemption of a bonus prize. An example of such points may be spaces on a game board such as tic-tac-toe or Monopoly™ or in the case of the Mills game, a collection of letters to form the word "BONUS". Once the player has accumulated the sufficient number of (e.g., collection of or arrangement of) game points, the player may be awarded a bonus prize. However, current systems do not allow a player to collect the player's game points on one machine for usage on a secondary machine for further collection of points toward prize redemption. Nor do current systems provide the collection of points on one machine for redemption of awards on another machine or a central (or separate) prize station. Current systems also fail to provide for collection of points on one machine for later aggregation with the same machine or a different machine during subsequent play.

Furthermore, current systems do not provide for a multi-level or investment style schemes for non-monetary prizes. As noted above, current bonus or progressive prizes present a single jackpot, perhaps at various prize levels. However, current systems fail to provide for accumulation of lower prize awards for subsequent opportunities at achieving higher level award prizes based on the accumulation of lower prize awards.

Current gaming machines also have no ability to incorporate non-gaming, intra-gaming, or inter-gaming promotional awards into game play, precluding a potential source of player participation and interest.

Thus, there is a need for a method and apparatus to enable players using gaming devices to broaden and maintain the gaming states that may apply to more than one gaming session.

According to some jurisdictions, gaming is restricted to lottery-based play, where a game results is selected from a fixed pool of outcomes, rather than from a randomly generated event. These systems also provide for similar bonus or progressive structures as described above utilizing fixed-pool schemes. The needs outlined above for an award and redemption system having movable game points or credits are also needed in lottery-based gaming environments.

BRIEF DESCRIPTION OF THE INVENTION

The present invention provides for method and apparatus to save and restore game state for user (player) using games in a gaming environment. The game states that may be saved are any and all that are enabled by the game itself. This may include award credits, game play credits, game play states (typically in a secondary or investment bonus game), and any other state a player may want to save (including results from a skill, semi-skill, non-skill or arcade game).

DETAILED DESCRIPTION OF THE PREFERRED EMBODIMENTS

Figure 1:
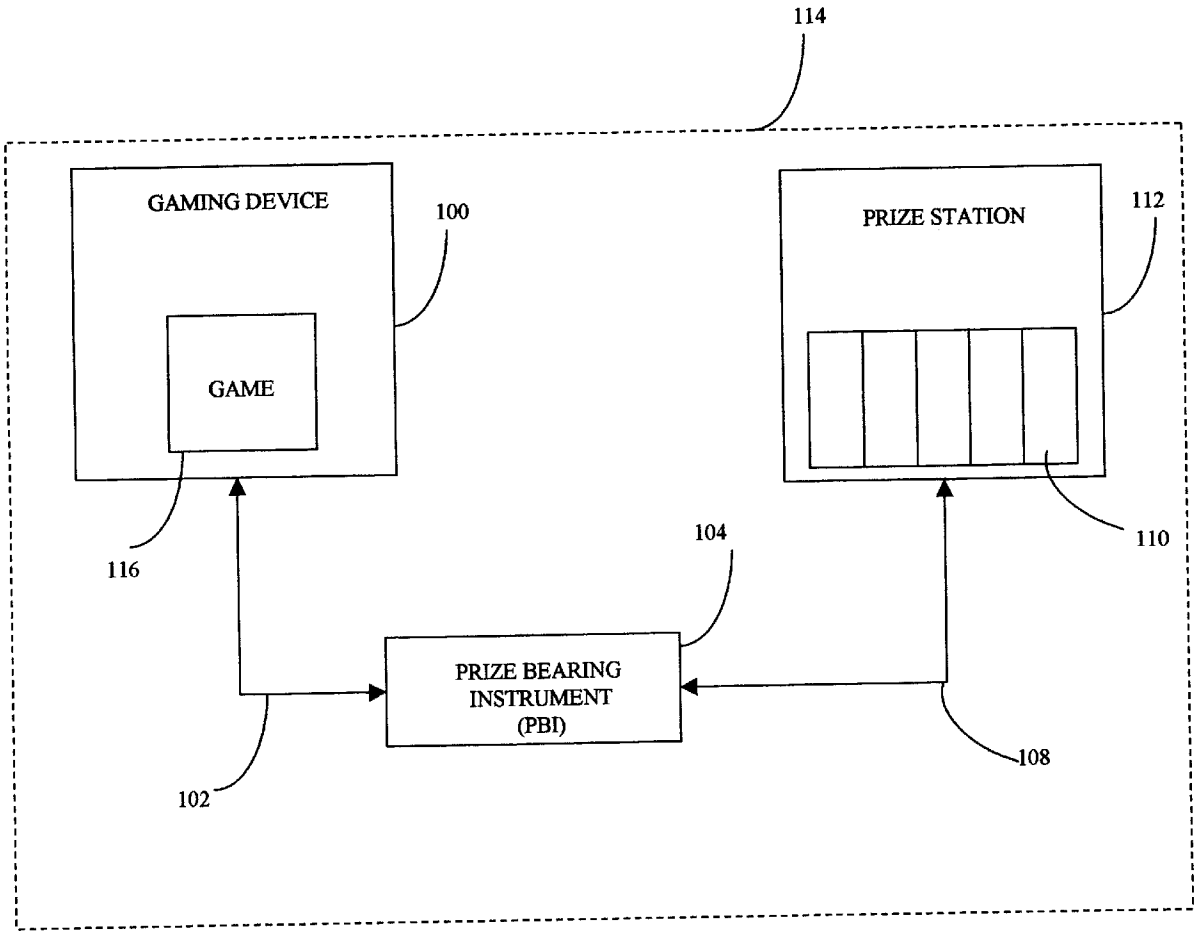
FIG. 1 is a functional block diagram of an example system for maintaining award game states in accordance with the present invention.

Persons of ordinary skill in the art will realize that the following description of the present invention is illustrative only and not in any way limiting. Other embodiments of the invention will readily suggest themselves to such skilled persons having the benefit of this disclosure.

Referring to the drawings, for illustrative purposes the present invention is shown embodied in FIG. 1 through FIG. 15. It will be appreciated that the apparatus may vary as to configuration and as to details of the parts, and that the method may vary as to details and the order of the acts, without departing from the inventive concepts disclosed herein.

Referring first to FIG. 1, a block diagram of an example system for maintaining a player's award credit state is shown. System 114 includes a gaming device 100 and a prize station 112. Gaming device 100 comprises a conventional game of chance, such as a slot machine, video poker machine, video lottery device, keno machine, bingo machine. The gaming device 100 may alternatively comprise a live table game of chance, such as a blackjack table or roulette table, where the functions described herein carried out by the gaming device are carried out by a table attendant.

If gaming device 100 is not a live table game, then gaming device 100 further provides a game 116 configured for play by a player. Gaming device 100 would then include typical hardware and software components (not shown), such as a processor, memory, and input/output devices such as a video output and control inputs, and game software, for executing game 116. According to play of the game 116, one or more game results may provide the player with an "award credit". The game results may be provided by a game of chance involving random events or may be provided from a predetermined outcome selected from a fixed pool (e.g., a lottery).

Award credits, unlike game credits which are used for playing the game 100, may be directly redeemed for prizes or awards on prize station 112. Award credits may also be used in a meta-game. Although in the preferred embodiment award credits are not used for additional game play, the present invention fully encompasses embodiments which do provide for award credits being used to add to game play credits.

A meta-game is defined as using credits, award credits, promotional credits (defined below), or any other transferable result(s) from one or more individual games comprising a plurality of individual game units, towards a game that requires, in order to play, the output results (in terms of credits, award credits, promotional credits, special indicia, etc.) of previously played game or games, and where the meta-game is a different game than any of the games from which output results are being used.

In the simplest case (other than straight prize redemption using award credits) the award credits may comprise meta-game pieces which are collected by the player for use at prize station 112. In this example, the meta-game pieces may be part of a game board or puzzle and when the player has collected a particular subset (i.e., collection or accumulation) of meta-game pieces, the player uses those pieces to "play" prize station 112, where the combination of award credits will entitle the player to a particular prize or class of prizes. In other cases the award credits may entitle the player entry into a more complex meta-game, where the award credits are used in the meta-game in a similar way that currency is used in primary games.

Figure 2:
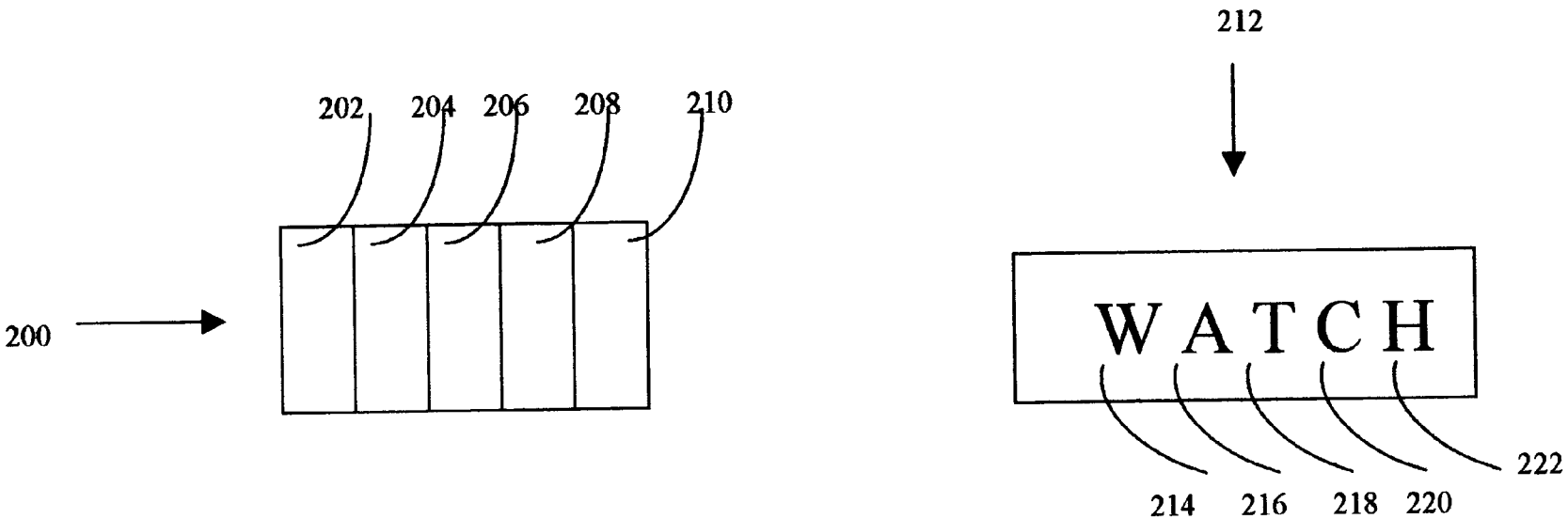
FIG. 2 is a functional block diagram of an example game board suitable for use with the present invention.

FIG. 2 illustrates a sample game board 200 having spaces for game pieces 202, 204, 206, 208 and 210. The game pieces 202 through 210 may be represented by indicia or representation to a particular theme, such as a popular board game, television show, movie, etc. Game rules may require accumulation of all or part of the game pieces 202 through 210 for different levels of prize awards.

FIG. 2 also illustrations a second sample game board 212 having letter space holders to accommodate letters 214, 216, 218, 220 and 222 corresponding to the word "WATCH". This game allows a player to collect letters (game pieces) from the word "WATCH" during game play of the primary game, normally a slot game. Once the player has collected all the letters, the player may redeem a prize corresponding to "WATCH" from the prize station. Numerous other game board formats and rules suitable for use with the present invention will be readily apparent to one of ordinary skill in the art and with the benefit of the present disclosure.

Referring back to FIG. 1, according to one aspect of the invention the gaming device 100 is configured to maintain a record of the accumulated award credits (game pieces) associated with the player, including award credits earned during play of the game 116. The player may maintain the player's state of award credits earnings (e.g., award credit game state, or award credit state) even when the player has terminated play of the gaming device 100. In one embodiment, the player's game state is maintained via a prize bearing instrument (PBI) 104. PBI 104 may comprise any media suitable for associating a player's award credits with the player. Example media include a printed ticket (voucher), a magnetic or smart card, or other information storage medium. As an interface to PBI 104, gaming device 100 provides a PBI reader/writer device (not shown) capable of reading PBI 104 and writing to (or generating) a PBI. PBI 104 will typically contain one or more data records indicating the number of (or collection of) award credits earned by the player. For vouchers, gaming device 100 will include a voucher reader and a voucher printer that is in operable communication with gaming device 100. When the player selects to terminate play, gaming device 100 prints a voucher indicating the number of award credits earned by the player.

Gaming device 100 is also configured to determine the accumulated award credits previously earned by the player, generally by reading PBI 104 as presented by the player and identifying any award credits indicated. The previous award credits may have been earned from the same gaming device 100 or a similar gaming device having the same underlying feature set of gaming device 100.

The award credits previously earned as identified by gaming device 100 are accumulated with further award credits which the player may earn during current play of gaming device 100. The accumulated award credits may be maintained by the player at the termination of play of the gaming device 100 via another PBI 104 which indicates the overall accumulated award credits earned. PBI 104 thus preserves the "award credit game state" or "game state" of the player in terms of award credits upon termination of play on the gaming device. The player may later resume play of the gaming device 100 at the preserved game state by presenting PBI 104 to game device 100 as described above.

In the example "WATCH" game 212 of FIG. 2, the player retains the player's earned letters (investment) so that when the player later continues play either on the same or different game, the player's letters (investment) is retained and restored and the player resumes play from the preserved game state. Although described herein for the purposes of redeeming tangible prizes and service, it will be readily apparent to those skilled in the art that the present invention is suitable for use with preserving game states (e.g., award credits, game pieces) for use with bonus games, progressive games, investment bonus games, among others.

Continuing with FIG. 1, prize station 112 contains one or more prizes 110. The prizes may be tangible goods (e.g., diamonds, keys to a car, event tickets), services, or monetary awards. Although not required for operation of the invention, the prizes are not generally redeemable directly via cash payments by the player to the prize station or the game devices. Rather the prizes are normally redeemable via award credits earned by the player from playing gaming device 100. The redemption process indicated by double-headed arrow 108 is manually initiated by a player, as is the playing process indicated by double-headed arrow 102. Both paths make use of PBI 104. Redemption path 108 is executed by presenting one or more PBIs to prize station 112. Prize station 112 is equipped with a PBI reader/writer device (not shown) for reading PBI 104 and determining the award credits associated with the player from data provided by PBI 104. The prize station then determines the prizes to which the player is entitled according to the award credits earned by the player. For example, prizes may be selected according to the number of award credits earned (e.g., using a hierarchical prize level arrangement) or according to the collection of types of award credits earned (e.g., game pieces on a game board or puzzle) or both. Other prize payout arrangements may also be used.

After the player's selection, the selected prize is awarded to the player. According to one embodiment of the invention, the prizes are maintained in vaults having doors secured by latches and windows to thereby allow the player to see the prizes inside the vaults and yet provided a level of security by limiting access to the prize. A button actuator receives the player's selection. In response, the latch is released allowing the player to open the door and retrieve the prize. In another embodiment of the invention, an attendant provides the prize to the player in response to the player's selection. Security measures may also be implemented including verification of the PBI via a validation server, which verifies transactions indicated by the PBI against records in a database (not shown). Additionally, if an attendant tenders the prize, the attendant may be required to present a code or electronic key identifying the attendant. This identifying information may then be verified against a validation server to determine whether the attendant has sufficient authority to tender prizes to players.

In another embodiment of the present invention, the prize station 112 comprises a conventional computer having a display monitor to present the prizes. In this embodiment, a web site may be used to provide an interface to which the player redeems award credits. In yet another embodiment of the invention, prize delivery may be made using a conventional courier services or mail service.

Figure 3:
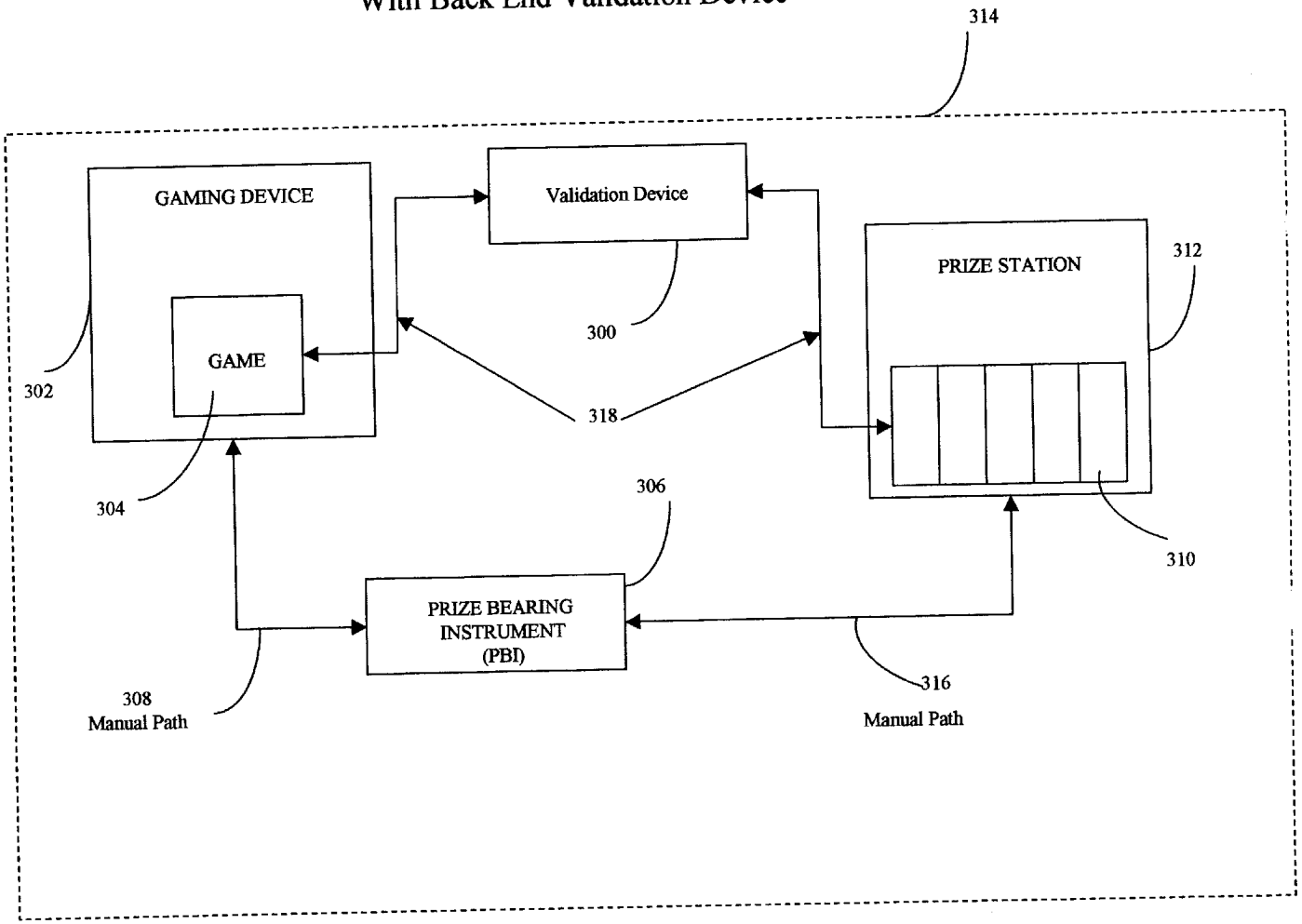
FIG. 3 is a functional block diagram of another example system for maintaining award game states in accordance with the present invention.

Referring now to FIG. 3, another embodiment of a system for maintaining a player's award game state in accordance with the present invention is shown. System 314, like system 114 described above in conjunction with FIG. 1, comprises a gaming device 302 for playing a game 304 and a prize station 312 comprising one or more prizes 310. System 314 further comprises a validation device 300 which typically comprises a server computer configured with conventional hardware and software components (not shown). Validation device 300 is operatively coupled for communication with gaming device 302 and prize station 312, normally via a network connection, shown as connections 318.

Validation device 300 may function in one of a number of ways. According to one aspect of the present invention, validation device 300 may serve to validate award credits which are earned and collected by the player on gaming device 302 and redeemed for prizes at prize station 312. Various validation means known in the art may be used to carry this out, including maintaining transaction records on validation device 300 which corresponds to transaction records identified on the player's PBI 306.

According to another aspect of the invention, the use of validation device 300 eliminates (or reduces) the need for recording the actual award credits onto PBI 306. Rather, validation device 300 may serve to maintain the award credits associated with players in a database (not shown). Under this arrangement, the player is identified with a record in the database, which further identifies the award credits earned by the player. The player may use any means for identifying herself to gaming device 302 or prize station 312, including using a personal identification number (PIN) or using an identity PBI 306, which instead of bearing the award credits earned by the player provides a unique identifying information to identify the player's corresponding game state (e.g., award credits or game pieces) information. The use of PBI 306 is indicated by double-headed arrows 308 and 316; both show a manual path of use by the bearer of the PBI. In each case the bearer of PBI 306 would insert it into a PBI reader at the target location.

Figure 4:
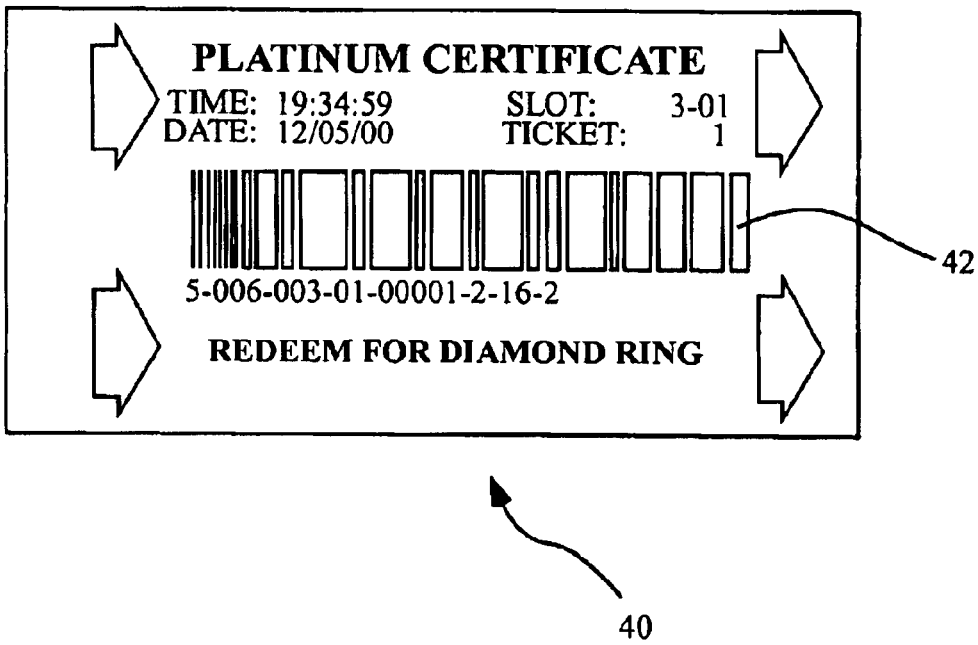
FIG. 4 depicts a sample voucher ticket suitable for use with the present invention.

FIG. 4 depicts an example ticket voucher 400. Ticket voucher 400 includes a data record in the form of a UPC bar code 402. As described above in conjunction with FIG. 3, this data record may identify the player's award credits or may alternatively identify the player's corresponding record in the validation unit's database.

Figure 5:
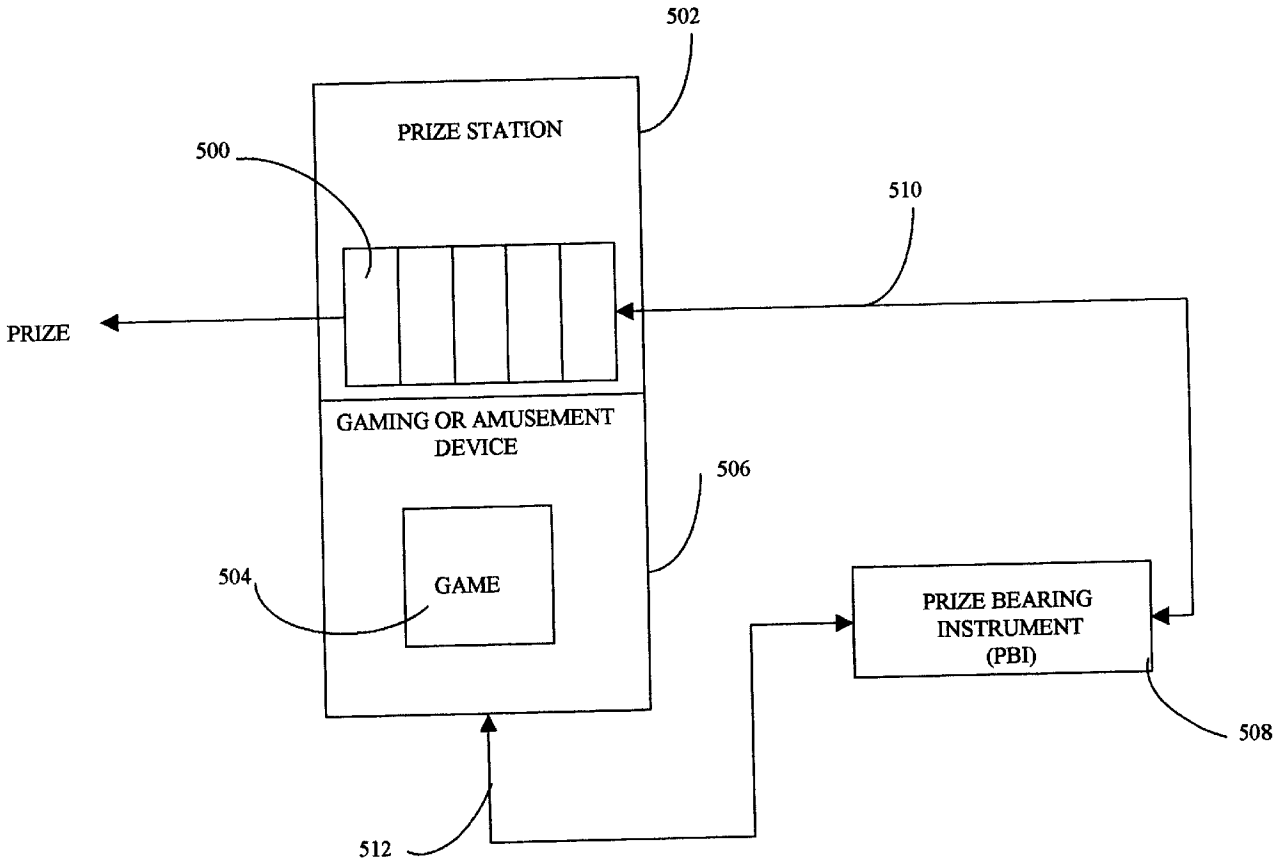
FIG. 5 is a functional block diagram of another example system for maintaining award game states in accordance with the present invention.

FIG. 5 illustrates another example embodiment of a system for maintaining a player's game state in accordance with the present invention. The system has a gaming device 506 suitable for playing a game 504 and a prize station 502 having one or more prizes 500. Gaming device 506 and prize station 502 are integrated into a single unit.

Gaming device 506 and prize station 502 may further be operatively coupled for communication to allow prize redemption to be made by the player via the gaming device. In this embodiment, the gaming device may include a monitor or other display device (not shown) for displaying game play as well as prize selection on a single display unit. The gaming device may further be coupled to or configured to be coupled to a network for connection to the global information network (Internet). Under this arrangement, a web-based scheme may be use to provide prize selection and to select delivery method directly on the gaming device. In this environment, the player's award credits may be used for shopping online. For example, a prize selection may allow a player to purchase a predetermined amount of goods or services from pre-selected online merchants. PBI 508 may also be used as described above in FIG. 1 and FIG. 3. Path 512 shows manual use of PBI 508 with the player inserting/withdrawing PBI 508 from gaming device 506. Path 510 may be either a manual path, where the player inserts PBI 508 into a reader associated with prize station 502, or may include an electronic connection between gaming device 506 and prize station 502, where PBI 508 may be issued after completing a transaction at both gaming device 506 and prize station 502.

Figure 6:
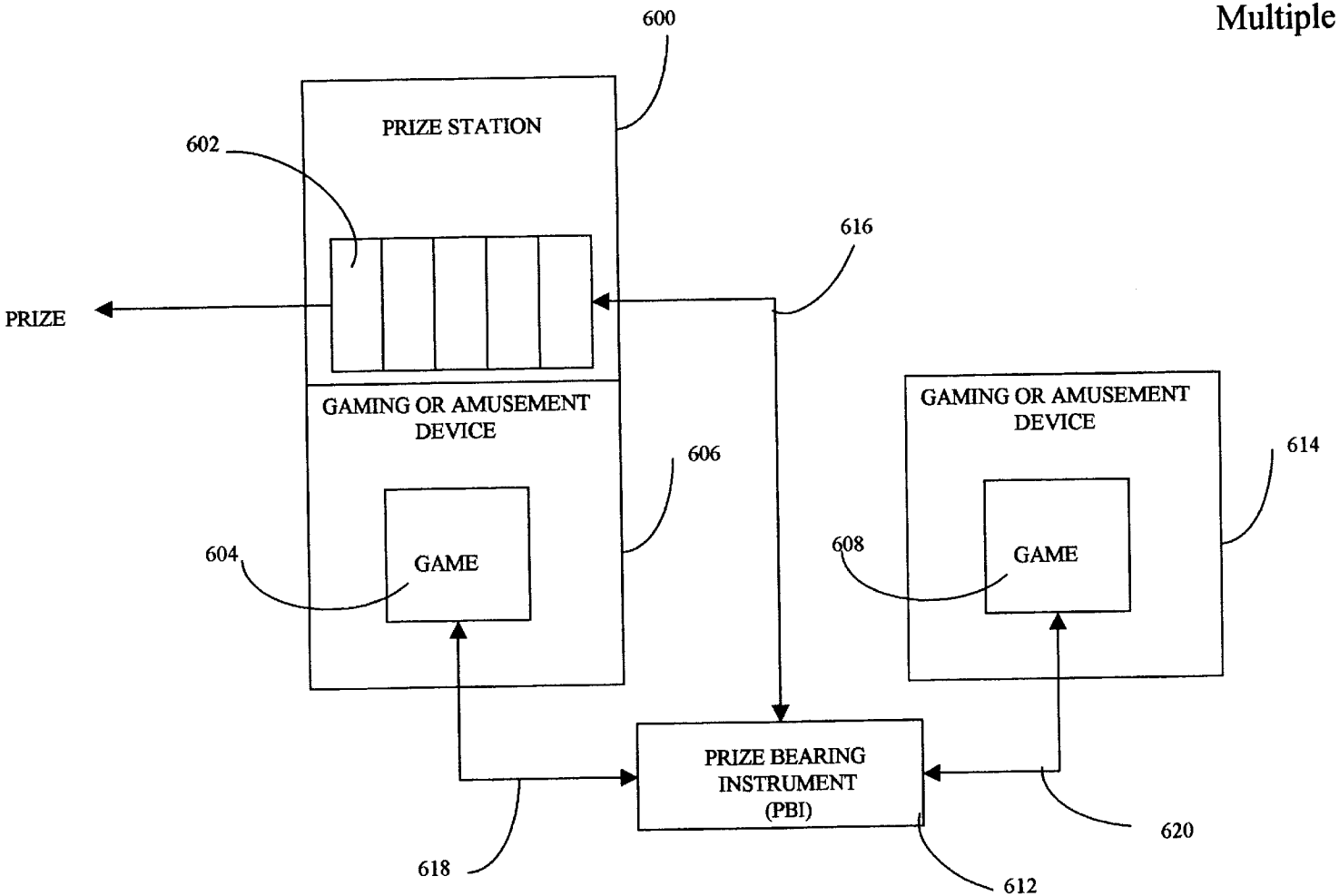
FIG. 6 is a functional block diagram of another example system for maintaining award game states in accordance with the present invention.

Referring next to FIG. 6, shown is another example embodiment of the present invention for maintaining a player's award game state. There is a game device 606 having a game 604 for play and another game device 614 having a game 608 for play. The game device 606 is integrated with a prize station 600 as described above in conjunction with FIG. 5.

The award credits earned by a player on game device 606 may be maintained and later presented and accumulated with additional award credits on game device 606 or game device 614, normally via PBI 612, although as noted above a validation unit may be used to perform this game state maintenance function on the "back-end". Likewise, award credits earned by a player on game device 606 may be maintained via PBI 612 for presentation and accumulation of further award credits on game device 614 or game device 606. PBI 612 may be presented to the prize station 600 for prizes shown generally as 602. Paths 616, 618, and 620 show the different uses to which PBI 612 may be used in this embodiment. Paths 618 and 620 are award credit creation/gathering by manually using (or receiving) PBI 612 from gaming devices 606 and/or 614. Path 616 indicates the manual use or retrieval of PBI 612 after using prize station 600.

Figure 7:
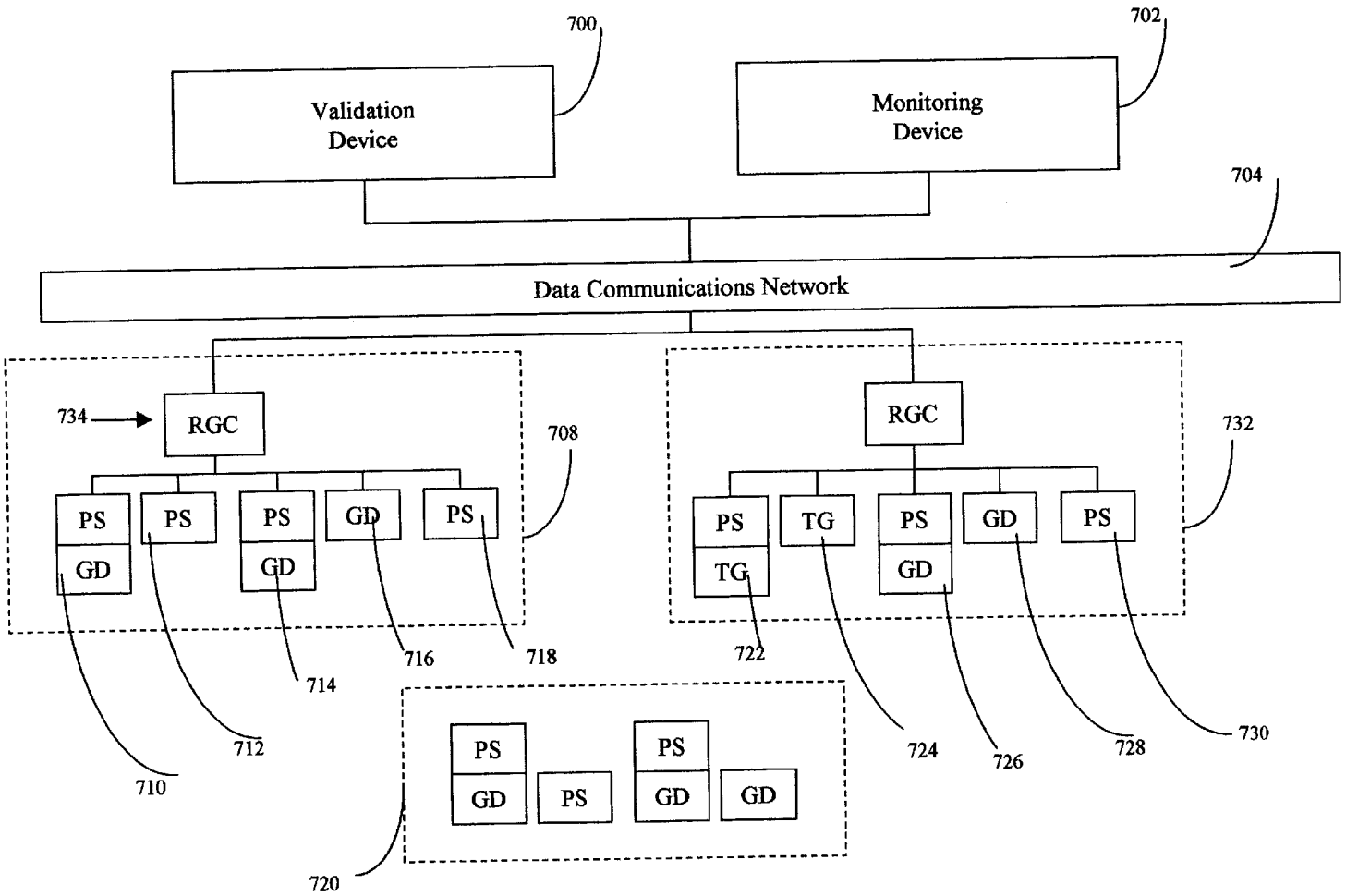
FIG. 7 is a functional block diagram of another example system for maintaining award game states in accordance with the present invention

Turning now to FIG. 7, there is shown another example award state maintenance system which comprises a plurality of individual systems grouped as 708, 720, and 732. FIG. 7 illustrates that a wide variety of systems and subsystems may be utilized with the present invention. Subsystems include those that are both connected and unconnected.

Systems 708 and 732 are each operatively coupled for communication to a validation device 700 and a monitoring device 702 via a data communications network 704. System 708 comprises a plurality of game devices and prize stations each coupled to a conventional remote game controller (RGC) 734. RGC 734 is coupled to communication network 704 for communication with the validation and monitoring units. System 708 includes individual game device 716 and prize stations 712 and 718. System 708 further includes integrated game devices and prize stations 710 and 714. Award credits earned in any of the gaming devices may be maintained according to the present invention, including a PBI, validation unit 700, or via a combination of the PBI and the validation unit 700 as described above. The present invention encompasses configurations that allow system 708 to issue award credits that may or may not be used on system 732 or on system 720; any subsystem may be configured to accept or reject award credits from other subsystems, depending on the needs of the particular installation.

System 732, like system 708, comprises a plurality of game devices and prize stations each coupled to an RGC, which is coupled to communication network 704. The game devices of system 732 include table games (TG) 722 and 724 as well as conventional gaming devices 726 (with integrated prize station) and 728 and a non-integrated prize station 730. Table games 722 and 724 are maintained by an attendant or dealer for the particular table game (e.g., blackjack, roulette). Each table game is also equipped with a PBI reader/writer (not shown) to enable a player of the table game to present her PBI and establish the player's existing or previously earned award credits. Certain game results (such as consecutive blackjacks) may result in further award credits to be earned by the player during play of the table game. At the completion of play the PBI reader/writer may be activated to generate a PBI to give to the player after play is completed. As noted above, the award credits may alternatively be managed by validation device 700 in conjunction with individual PBIs, or without the need for a PBI where a player has a PIN number to identify the player. Table game 722 differs from table game 724 in that table game 722 further has in combination a prize station, where a player may redeem award credits for prizes.

System 720 also comprises a plurality of gaming devices and prize stations, but unlike systems 708 and 732 this system is not coupled to communication network 704. Each gaming device will use PBIs rather than validation device 700 and monitoring device 702. As discussed earlier, the overall system may be configured to allow or disallow PBIs generated from subsystem 708 or 732 to be used in the machines comprising subsystem 720 and vice versa.

Figure 8:
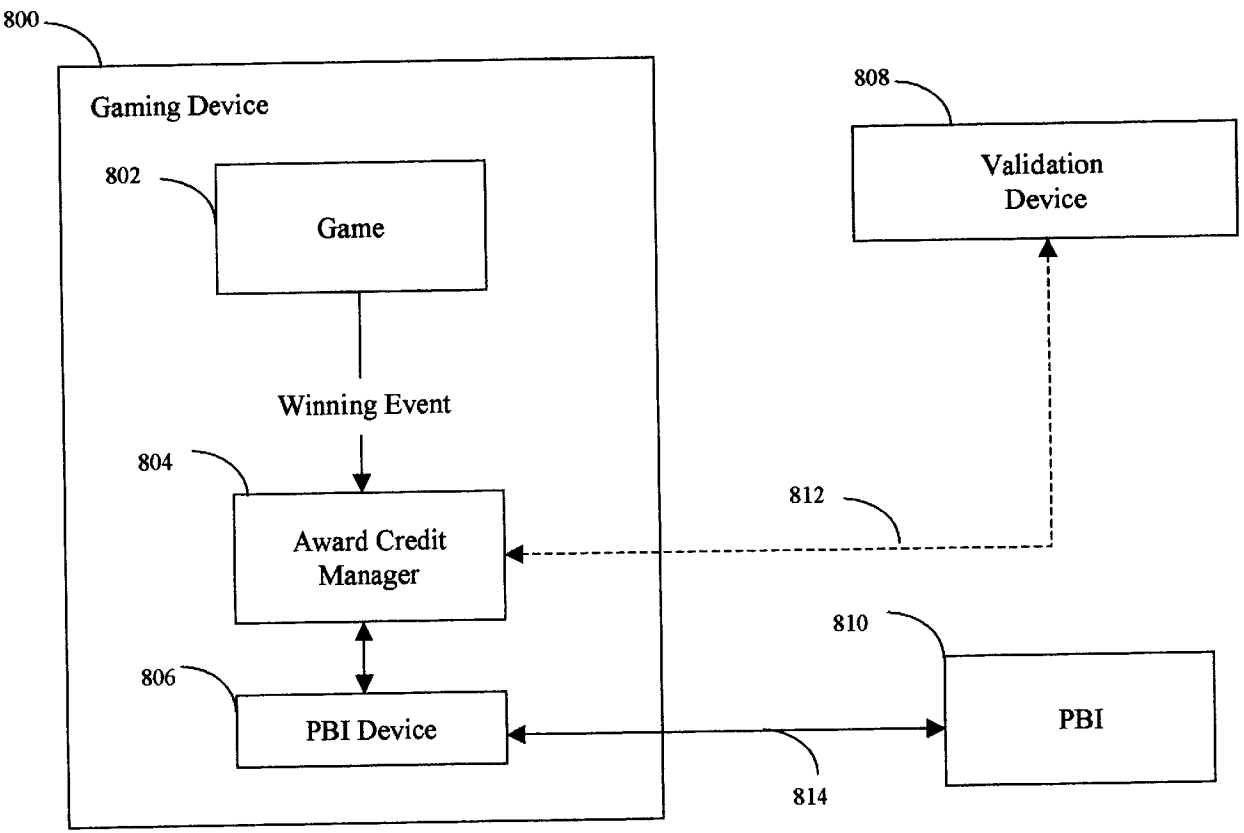
FIG. 8 is functional block diagram showing an example gaming device suitable for use with the present invention.

Referring now to FIG. 8, a gaming device is shown in additional detail. Gaming device 800 comprises a game 802 (skill, arcade, chance, semi-skill, fixed-pool) operatively coupled savable game state manager 804, which is also operatively coupled with a PBI input/output device 806. The PBI input/output device 806 is configured to read, write, generate, transmit, and receive information about PBI 810 as needed. Path 814 shows a manual usage path for PBI 810; the player must manually insert the PBI into the PBI reader. If PBI 810 comprises a printed ticket (voucher), the PBI input/output device 806 comprises a voucher reader for reading vouchers and indicia printed thereon, such as "Interleaved 2 of 5" bar codes. The PBI input/output device 806 would further include a voucher printer for generating vouchers when the player terminates play on gaming device 800.

Savable game state manager 804 carries out the operation of managing a player's award credits during play. If a player presents a PBI 810 prior to playing, the previously earned award credits are identified either directly from the PBI 810 and/or from validation device 808 which communicates with the gaming device 800 over an electronic communications path 812. During play of the game 802, the player may earn additional credits or change savable state based on winning game events. These events are noted by savable game state manager 804 in conjunction with the previously earned savable game state, if any. Upon termination of play of the gaming device by the player, another PBI 810 may be issued to the player which contains data associating the cumulative award credits or other game state earned by the player.

Figure 9:
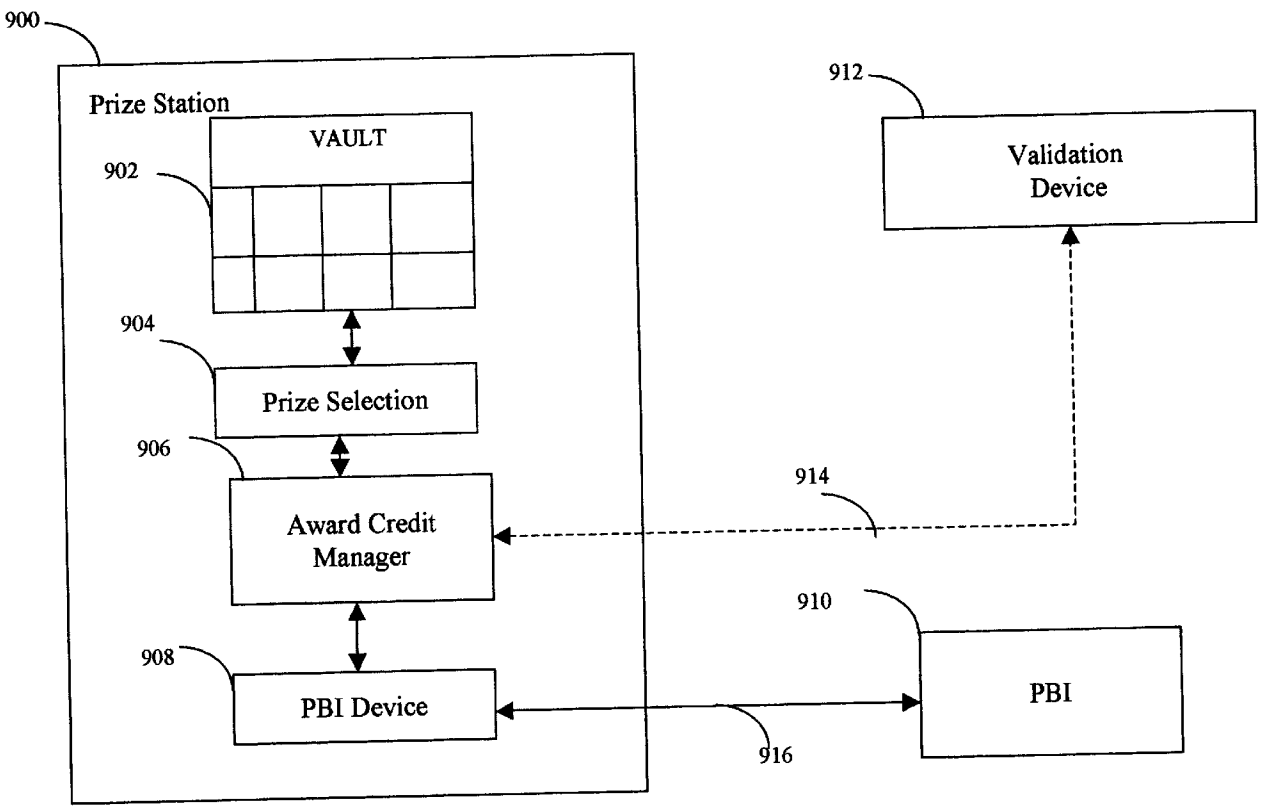
FIG. 9 is a functional block diagram showing an example prize station suitable for use with the present invention.

FIG. 9 shows a prize station in more detail. Prize station 900 comprises a PBI input/output device 908 operatively coupled to an award credit manager 906, a prize selection module 904 coupled to the award credit manager 906, and a plurality of prizes maintained in vault 902, the vault operatively coupled for communication with the prize selection module 904.

When a player presents one or more PBIs to prize station 900, shown as PBI 910 and manual insertion path 916, the PBI input/output device 908 reads the award credits associated with the player. Award credit manager 906 determines the total award credits' value, either directly from PBI 910 and/or from validation device 912. Validation device 912 is operably connected to prize station 900 via electronic communications path 914. Prize selection unit 904 offers to the player one or more prize selections based on the player's total award credits. The player may select a prize selection or may cancel prize redemption. If a player selects a prize, the prize is awarded from vault 902. If the prize selection does not exhaust the player's total award credits, another prize selection may be offered to the player, if the remaining credits are sufficient to support a prize selection from the vault 902. If the remaining award credits are not sufficient to support a prize selection, the remaining award credits are maintained and associated with the player, normally by dispensing another PBI 910.

Where an attendant manages a prize booth to carry out the functions of the prize station in accordance with the present invention, the player presents one or more PBIs 910 to a PBI input/output device 908 associated with the prize booth to ascertain the award credits associated with the player. The player's award credits are indicated to the attendant, normally via a conventional video display device (not shown). The attendant then notifies the player of the prizes (and/or prize levels) to which the player is entitled according to the player's earned award credits. This can be carried out manually via a catalog (or a prize display booth) or automatically via the display device. In response, the player makes a prize selection, and the attendant either manually tenders the prize to the player or provides automatic (via vending device) or courier delivery (e.g., mail, parcel service) to the player.

Figure 10:
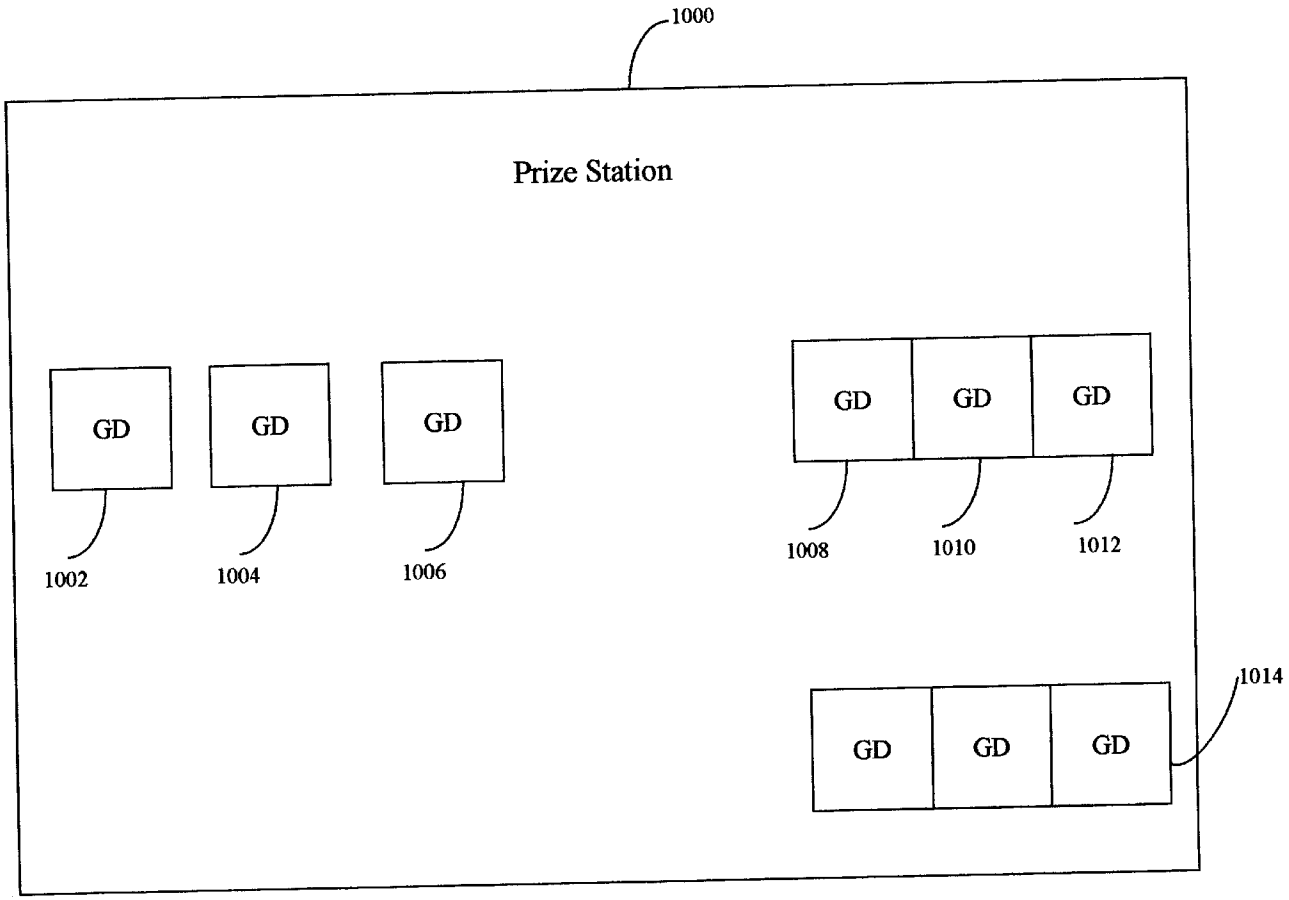
FIG. 10 is a functional block diagram depicting meta-games suitable for use with the present invention.

FIG. 10 illustrates two additional meta-game systems which may be implemented using the game state maintenance system of the present invention. FIG. 10 includes a prize station 1000 and a plurality of gaming device indicators illustrated as gaming device indicators 1002, 1004, and 1006. Each gaming device indicator corresponds to a gaming device on the game floor; there may be as many gaming device indicators as there are individual games in actual implementations or they may be grouped for convenience. Under this arrangement a particular prize awarded by the prize station 1000 may require an award credit from each of the gaming devices indicated by 1002 through 1006 or a predetermined subset, such as three award credits where at least two of three must come from different gaming devices. Various other award requirements may also be used and will readily come to mind for a person of ordinary skill in the art and with the benefit of the present disclosure.

Another example of a meta-game involves banks of gaming devices. Bank 1 is shown having individual gaming device indicators 1008, 1010, and 1012. Bank "n" is referenced generally as 1014, and is understood to further comprise individual gaming device indicators not individually labeled. There may be any number of banks between bank 1 and bank "n". Prize station 1000 may require an award credit from each bank of gaming devices (corresponding to the gaming device indicators) in order to receive a particular prize. Each bank may be configured as the same game (e.g., blackjack), the same device type (e.g., slot machine), the same family of game (e.g., games manufactured by Sierra Design Group™), or other arrangement.

Figure 11:
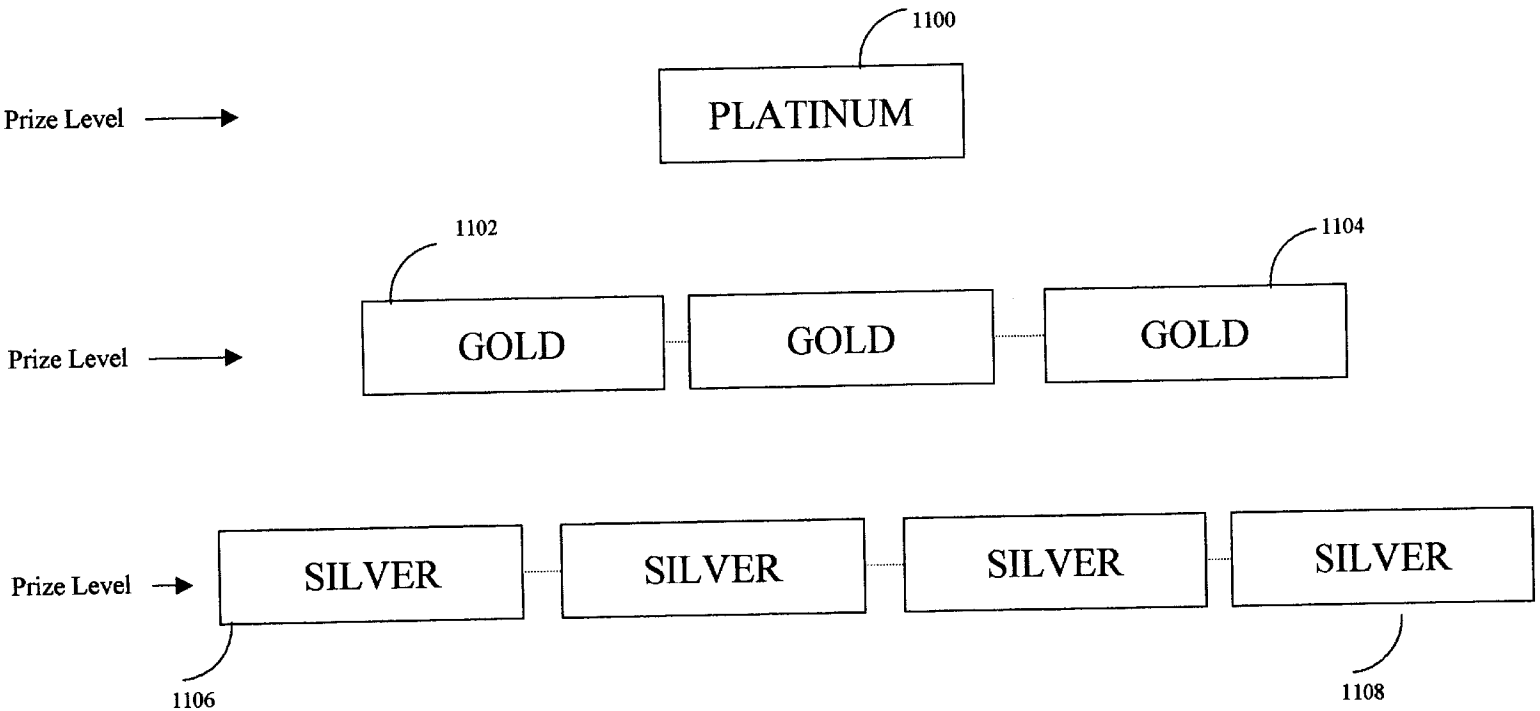
FIG. 11 is functional block diagram showing prize organization suitable for use with the present invention.

FIG. 11 illustrates a sample hierarchical prize level arrangement suitable for use with the present invention. The sample arrangement includes prize levels comprising a silver level (1106 through 1108), a gold level (1102 through 1104), and a platinum level 1100. One or more prizes may be associated with each level. For example, bracelet prizes may be available at the silver level (1106 through 1108), watches may be available at the gold level (1102 through 1104), and diamond jewelry may be available at the platinum level (1100). According to this arrangement, the gaming device may provide silver level award during play. The player may decide to redeem the silver award for one of the bracelet prizes, or the player may elect to accumulate additional silver level awards by playing the same or another gaming device.

The prize values in this example are arranged hierarchically, where two of the prizes at one layer are worth one of the prizes at the layer above. Two silvers awards may be used to redeem either two silver prizes or one gold prize. Similarly, the player may accumulate four silver awards and use them to redeem one platinum prize, two gold prizes, four silver prizes, or one gold and two silver prizes. A player retains any unused (unredeemed) credits during prize redemption. Thus, if a player has accumulated four silver awards, the player may decide to redeem a gold award (at the cost of two silver awards), and retain two remaining silver awards for later use or accumulation.

Having the ability to save award credit state creates the need and desire to save other states associated with a gaming device. A player will be particularly interested in saving the game state of a game that involves the accumulation of play points or play state, where the game state is not tied to award credits (or perhaps not yet tied in to award credits but could be).

Generally, game states other than award credit states fall into one of two categories. The first is saving credit state, that is, saving state when working towards an award or credit, where the game's state is derived from a game of chance or from a result from a fixed-pool set of results. The second is saving any other game state that effects the state of the game as it appears to a player if they leave and return later, typically a skill game where the player has reached a certain level or point value and doesn't want to have to start over.

Figure 12:
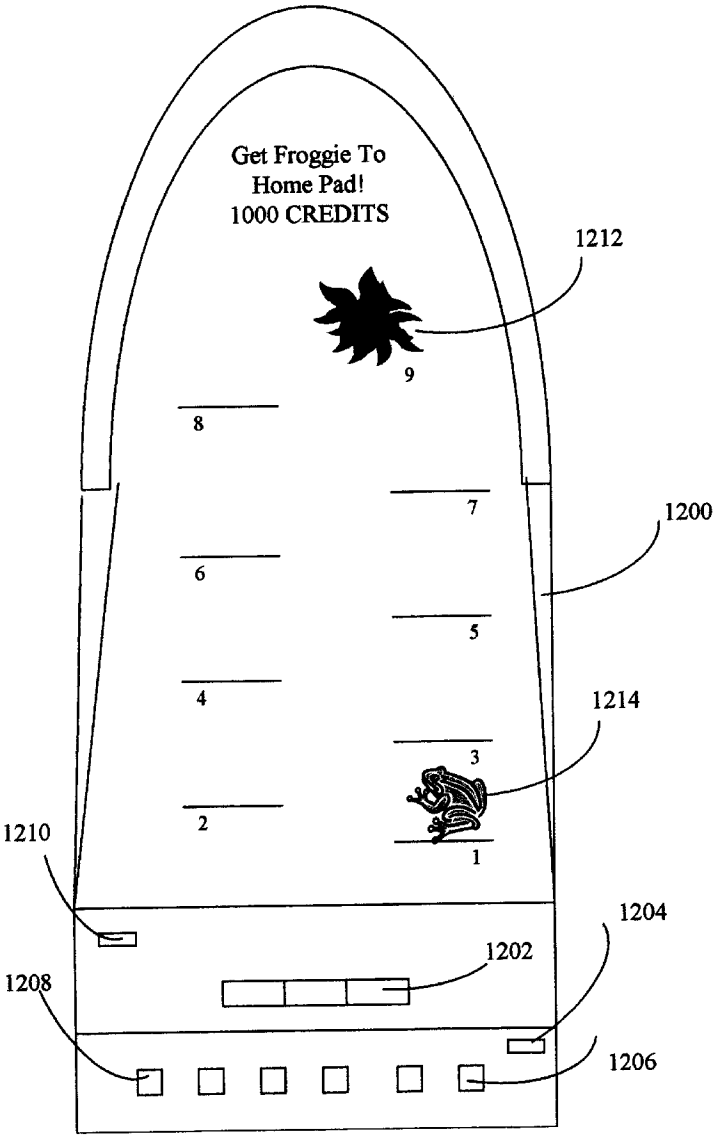
FIG. 12 is a functional block diagram depicting a game state saving game suitable for use with the present invention.

An example of the first type is shown in FIG. 12. This is a state saving game associated with games based on chance (or fixed-pools) and working towards an award state. Typically the goal, if reached, is playing credits or award credits. Gaming device 1200 has a standard primary game with indicia windows shown as 1202. The primary game may be any of the well known reel games, poker games, keno, bingo, fixed-pool games, etc. There is a panel of player buttons, shown between buttons 1206 and 1208, used for the primary game. Any layout and interface may be used, from a fixed number of physical buttons to a dynamic layout of touchscreen buttons. Also included is an output slot 1204 and an input slot 1210. Input slot 1210 accepts ID cards, ID vouchers, smart cards, game state vouchers, or any other means used to present gaming device 1200 with credits, states, or ID. If presented with ID, gaming device 1200 must be in operable communication with a back-end database (not shown), typically over a LAN (not shown). The communications means is used to retrieve data associated with the presented ID.

Voucher IDs are intended to be used by people who may be at a casino for more than a brief time, but who do not want to be entered as "players" in the casino's database (typically used by casinos for player tracking purposes and by players to be awarded player tracking points). This may include people who want to play a series of games over an evening or a week, want the convenience of having some gaming data kept on a back-end database, but do not want to give the casino their personal data. The player may chose to use a voucher ID, which is simply any media on which a unique identifier is recorded (typically an alpha-numeric sequence). This may include a card with a magnetic strip, smart card, bar-coded voucher, or any other form of readable media that can easily be carried by a person. Gaming device data, discussed below, can now be associated with the "voucher ID" rather than a traditional player's card. Typically voucher IDs would be given limited life spans, specified by the holder or establishment.

Like traditional player cards, the player using a voucher ID may be awarded "points" according to conventional methods for calculating player tracking incentives or awards. Later, the player may redeem the points by presenting his/her voucher ID at redemption sites established by the casino. Redemption sites could include, but are not limited to, restaurants, bars, hotels, or customer counters.

Returning now to FIG. 12, when playing the primary game there will be game states, indicia, or other aspects of the primary game that will trigger the secondary game. In this example, the secondary game is the "Froggie" game. Each time the secondary "Froggie" game is invoked by the primary game, frog 1214 will advance up one step. The secondary game starts at step 1 (the steps are labeled). With each invocation of the "Froggie" game, frog 1214 advances one step. After 7 invocations frog 1214 will be sitting on step 8. With one more trigger of the secondary game, the player will get the frog to its home pad 1212 (step 9) and will be awarded either 1000 game credits. Alternatively, the number of steps the frog advances on each secondary game invocation can be partially determined by the indicia shown on the primary game, allowing for more than one "hop" per invocation. When the frog reaches its home pad 1212, the game may present the player with the option of award credits instead of play credits.

The player has the option of saving the state of the game at the start of each primary game play. In this example, the state saved would be the state of the secondary game, specifically the frog's current step location. If the player plays "Froggie" enough to advance frog 1214 to step 5, the player may touch button 1206, the "save state" button, and receive a print-out in the form of a voucher from output slot 1204. Immediately after saving the game state to a voucher, the game resets itself to the base state, with frog 1214 back on step 1. The player may now leave the game for a while and come back, inserting the previously generated voucher into slot 1210. The game will set itself to the state saved, in this case placing frog 1214 on step 5. The game is now ready to be played.

Typically the game state just recovered will be available for a fixed length of time, perhaps 3 minutes. The game must be played within that allotted time or the game reverts to its start state and the game state voucher value is lost. If the player inserts the game state voucher and decides not to play the game, the voucher can always be recovered by pressing the "save state" button before the allotted time is up. Although discussed in terms of vouchers, any read/write media may be used in addition to having all the game state data stored in a back-end database, accessed by an ID card, PIN, ID voucher, etc. All such methods of saving game state are fully contemplated by the current invention.

The advantages of saving game state are increased interest in investment bonus games by the players. With the ability to save their state, players who must leave without having reached the winning secondary game state have a much higher incentive to return and continue playing.

Figure 13:
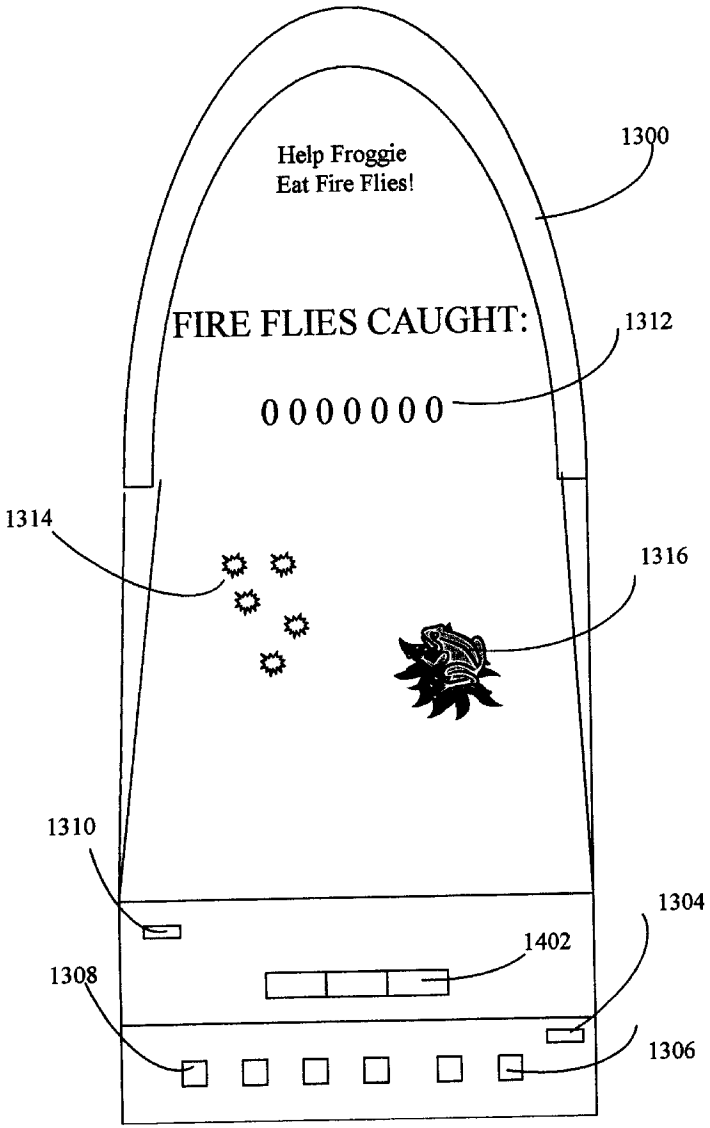
FIG. 13 is a functional block diagram depicting another game state saving game suitable for use with the present invention.

In addition to saving game state associated with awards, game state may be saved simply to keep a score on a non-award game or skill game. An example of this type of game state is shown in FIG. 13. In gaming device 1300 there is a primary game, indicated with indicia windows 1302. The primary game may be any game of chance or a fixed-pool game, including but not limited to poker, keno, reel-games, etc. Buttons shown between 1306 and 1308 are used to play the primary game in its known manner. Also included is input slot 1310 for reading any convenient input form that may be used to record game state. This includes but is not limited to vouchers, magnetic strip cards, smart cards, player IDs, ID vouchers, etc. Output slot 1304 is used to give any form of game state saving media to the player on request, typically some form of voucher or magnetic media. Button 1306 is used for secondary game play; button 1308 is a "save state" button that directs the gaming device to save the current state of the game. All this is shown for illustrative purposes only and can take a plethora of functionally equivalent forms, including configurations with just a single game In this case, when the secondary "Froggie" game is triggered or invoked from the primary game, the player can play the game for skill points. Frog 1316 has a tongue (not shown) that can be extended by pressing button 1306. A plurality of "fireflies" shown as 1314 are flying near frog 1316. A player presses button 1308 when a firefly is in line and near the frog's mouth, getting points thereby. The player accumulates points that are recorded on the screen at 1312.

When the player needs to leave the machine for a time, the player has the option of pressing "save state" button 1306 and saving the game state of the machine that can be saved—in this case, the players score on the secondary game. The player will be issued a bearer record from output slot 1304 on which is recorded the game state. When the player returns later, the player inserts the readable media into read slot 1310 and the game will reset to the saved state.

In a preferred embodiment, the saved game state will also have an expiration date associated with it. The idea is to encourage a player to maximize their skill point score within a specified period of time (thereby encourage game use in general during the same period). The expiration time picked would depend on the game type, the player's average stay, as well as other factors, but would typically be in hours or days.

The saving of game states discussed above includes award states, "partial" award states (secondary or bonus game state, before award points or prizes have been awarded) and skill game states. Also included is the fact that any game state that is allowed to be savable by a player may be saved. This determination may be made by the gaming device itself, a back-end server with a database for networked gaming devices, or by parameters set by the operators or other accountable people. The examples given above are illustrative, showing preferred embodiments. They are not exhaustive; the inventive concept disclosed herein fully encompasses any savable game states.

Game state may be saved in an instrument similar to that of award credits; bar codes on a voucher, etc. The descriptions already given above for types of prize bearing instruments (PBIs) and devices that read, write, and use them apply equally for game state instruments (GSIs). The same is also true of the system architectures described for use with PBIs—all the descriptions hold equally true for use with GSIs. Whereas the information contained on a PBI is related to prize redemption, the information on a GSIs is to save game state.

If both award credits and game state saving games are used in the same establishment or casino, the preferred embodiment is to combine the two. The amount of information that needs to be stored for both PBIs and GSIs is readily accommodated on any of the instruments described for the PBIs, and may readily be stored in the same database records with additional fields. In this preferred embodiment, a single bearer instrument would contain data for both award credit saving and game state saving, allowing users to carry a single instrument for both uses. It would look essentially the same as the example of FIG. 4, but perhaps with two bar code strips, one over the other, with the PBI and GSI information.

In addition to carrying information on saved game state for one gaming device, it is fully envisioned that the current invention will encompass the saving of game states for multiple games on a single bearer instrument. If the game state is being saved in a back-end database, this is the straightforward association of one player ID or voucher ID with multiple game state records, where the game state records include fields identifying the gaming device to which the saved state applies. For bearer instruments such as vouchers, multi-game, multi-state vouchers will be issued. These will be supported by readers that will read and understand (decode) the multi-game, multi-state instruments. And as discussed above, although vouchers are being used as an example of bearer instruments, any form of read/write media suitable for use as a bearer instrument is within the scope of the present invention.

Figure 14:
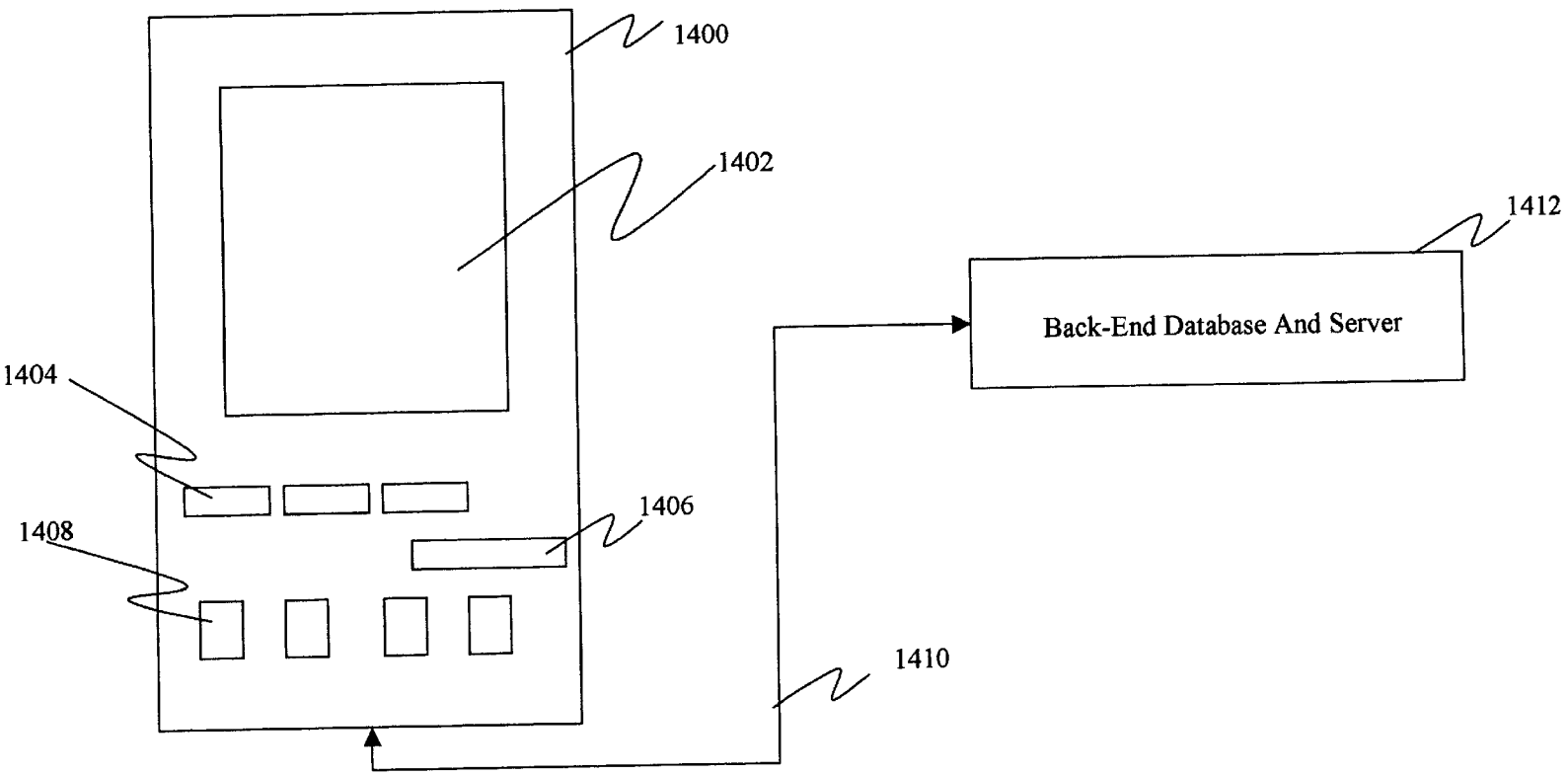
FIG. 14 is a functional block diagram of a GBI service station according to the present invention.
Figure 15:
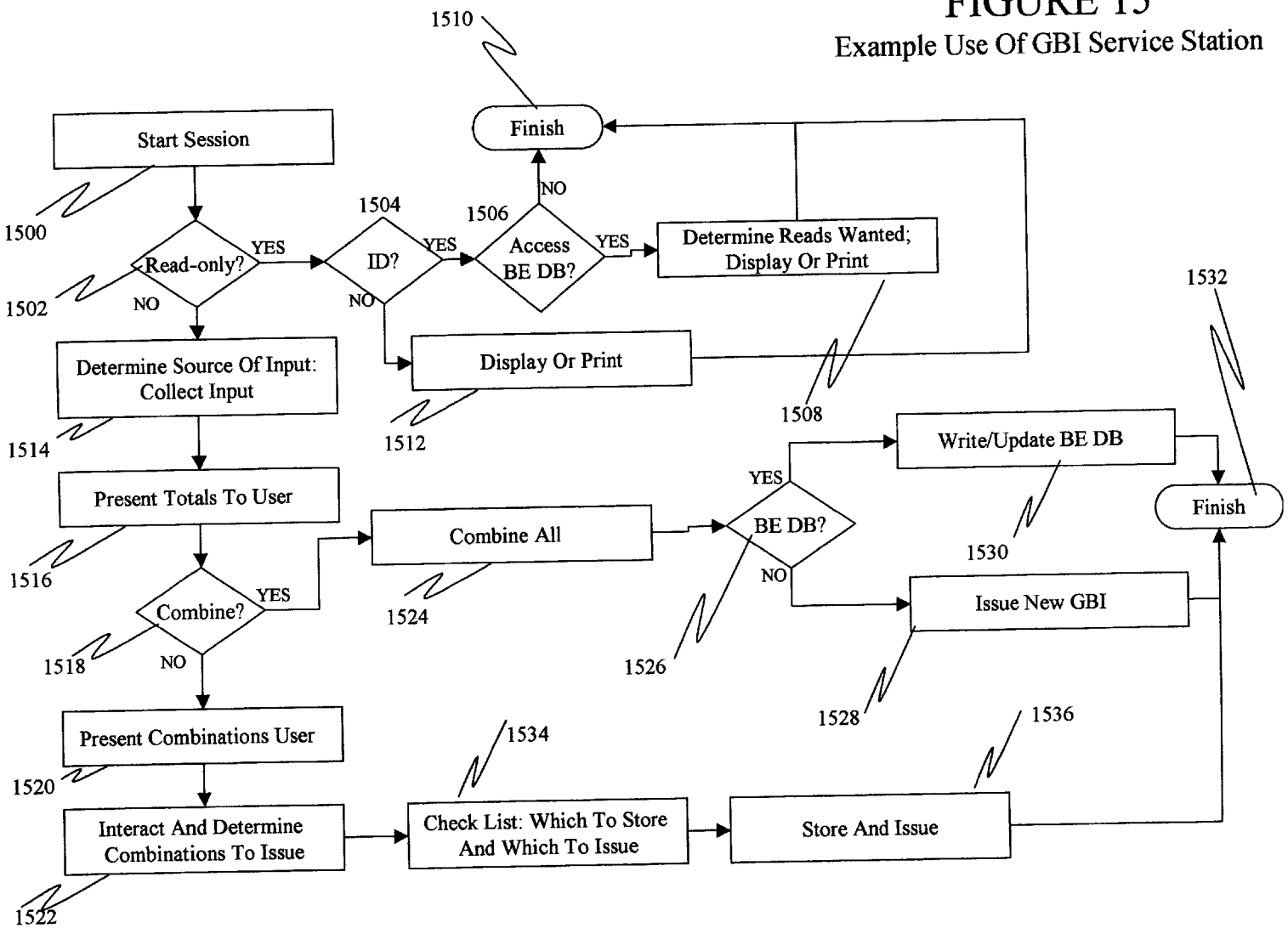
FIG. 15 is a flow diagram showing an example use of a GBI service station according to the present invention.

It is envisioned that casual players may well end up carrying multiple instruments after a while. To help them, as well as provide other related services including advertising and special promotional offers, the GBI service station will be provided. "GBI" stands for general bearer instrument, and is a combined form having PBI, GSI, or PBI and GSI information on it. FIG. 14 shows a functional block diagram of a GBI service station. Because the complexity of the interaction at the GBI service station is relatively high, a preferred embodiment will have a minimum number (if any) "hard" buttons, shown generally as buttons 1408. These hard buttons may provide a few preliminary choices, such as screen display only print-only, and read-out only functions (read-only functions are provided for people who forget what a PBI, GSI, or GBI has on it—it provides an English, Spanish, Japanese, or other language translation of what the instrument has on it, and then returns the instrument without further processing). An implementation using hard buttons may be preferred if the GBI service station has limited capabilities; for example one that only provides reading services and nothing else.

GBI service stations will also have at least one input slot, shown as 1404, and may have more than one. A minimal configuration will have an input slot for voucher-based PBIs, GSIs, and GBIs. Optional slots may be for magnetic cards, smart cards, player's cards, and related instruments carried by people. There will also be at least one printer output port, shown as slot 1406. Also shown is a video display 1402, further being a touchscreen for user input. GBI service station will preferably be connected to the establishment's or casino's back-end database 1412 via a LAN 1410 or functionally equivalent means. Being connected to a back-end database is optional; a subset of the GBI service station's primary functions can still be carried out without the connection, and in some installations (for security or other reasons) it may be desirable to have one or more GBI service stations installed unconnected.

The functionality provided by the GBI service station is geared towards helping users manage and understand any and all instruments and/or awards or credits they may have. This will be especially helpful to occasional users who do not play enough to "memorize" the meaning of the various instruments and awards. The user starts a session by pressing a hard button for certain limited functions, or inserting any applicable instrument in its' respective slot (i.e., player's card in a player card slot, PBI in the voucher reader slot). This action corresponds to entry box 1500 in FIG. 15.

The user initially decides if they want a read-only session at decision diamond 1502. If the answer is yes, the "YES" exit is taken to decision diamond 1504. If the user has presented a form of ID to the GBI service station (rather than some form of GBI credit), the "YES" exit is taken from decision diamond 1504 to decision diamond 1506. If the GBI service station can access a back-end database and the ID is recognized, the "YES" exit is taken to box 1508. Action in box 1508 includes asking if the user wants a display or a print-out, and then providing the user with the current state of any credits in the back-end database associated with the ID presented. Box 1508 is then left and the process finishes at finish 1510.

If, at decision diamond 1506, the ID was not recognized the process finishes immediately at finish point 1510 (with a polite message to that effect on the screen, of course!). If, at decision diamond 1504, the user presented something other than an ID the "NO" exit is taken and box 1512 entered. Action taken in box 1512 is to ask if the user wants the information in hardcopy or video form, present the information to the user in that manner, return the instrument to the user, and proceed to finish the transaction at finish 1510.

If, at decision diamond 1502 the answer was "NO", the user wants to do something more than have something read. The "NO" exit is taken to box 1514. Action taken in box 1514 is to determine from the user where to get input, and then to present all information to the user in total. There are basically two places from which data can be gathered. One is from instruments carried by the user and the other is from a back-end database. If the user requests information from a back-end database, the user is asked for ID. The ID can take any form, from a voucher ID to a player's card to a PIN. The user is then asked to submit instruments until they have no more (i.e., PBIs, GSIs, and/or GBIs). Once the user indicates to the GBI service station all sources of credits has been accumulated, the GBI service station combines like data and reaches a total. Combining like data consists of combining award credits, consolidating game state information for the same gaming device, etc. Much, if not most, of the data will not be able to be combined, it will simply be listed in order. An example of hard to combine data will be GSI data. On the other hand, award credits will always combine. Box 1514 is left and box 1516 entered.

The action in box 1516 is to present the information to the user in the most coherent manner possible. As before, the user may choose hardcopy or video output. Box 1516 is then left for decision diamond 1518.

In decision diamond 1518 the user is asked if they want to combine credits that are combinable, and re-issue the rest in as compact a form as possible. If the answer is yes, the "YES" exit is taken to box 1524. The action taken in box 1524 is to do the combinations possible, remove redundant or expired credits, etc. These calculations may be done in the GBI service station or in a back-end server in a networked environment. Box 1524 is then left for decision diamond 1526.

At decision diamond 1526 the user is asked if they want to store the information on a back-end database or if they want the credits re-issued to them in an instrument form, typically GBI vouchers. If the answer is yes to the back-end database storage, the "YES" exit is taken and box 1530 entered. Please note that if the GBI service station in use is not networked, clearly the "NO" exit is taken from this decision diamond.

In box 1530, the back-end database determines if the current user has an ID. If they do, the data is recorded in records associated with that ID. If not, the user is issued a voucher ID or equivalent and the data is then stored on the database using the newly issued ID. The process finishes by then entering finish 1532.

If the user indicated no at decision diamond 1526, then the "NO" exit is taken to box 1528. The action taken is to issue a new GBI to the user that incorporates all the valid credits listed for the user, included any combined credits. The process then finishes by leaving box 1528 and entered finish 1532.

If, at decision point 1518 the user answered no, the "NO" exit is taken to box 1520. Action taken in box 1520 is instruct the user on possible combinations. For example, a user may want a separate GSI game state vouchers (to give to a friend to use), or may want to divide up any award credits into even amounts on several different vouchers to distribute to friends. Any combination of vouchers may be created for the user. Box 1520 is left and box 1522 is entered.

Action in box 1522 is to put up interactive screens and determine the combination of vouchers the user wants the GBI service station to produce. After determining a set of vouchers equal in value to the credits and vouchers presented to the GBI service station at the start of the session, box 1522 is left and box 1534 entered.

The action in box 1534 is to present a list to the user of the newly combined credits and/or game states, and ask which are to be stored in a back-end database and which are to be issued as newly generated GBIs. The user indicates which are to be stored and which are to be issued in a GBI form. Box 1534 is left and box 1536 entered. The action taken in box 1536 is to store and/or issue the GBIs the user requested. As with box 1530, if the user currently has no ID for the database and requested some of the newly recombined credits or game states be stored on a back-end database, a voucher ID or equivalent will be given to the user at this time. The process now exits box 1536 and finishes by entering finish 1532.

The present invention has been partially described using flow charts. As will be understood by a person of ordinary skill in the art and with the benefit of the present disclosure, steps described in the flow charts can vary as to order, content, allocation of resources between steps, times repeated, and similar variations while staying fully within the inventive concepts disclosed herein.

Accordingly, it will be seen that this invention provides a system and method for maintaining player's award credits, game states in a secondary or bonus game, and gaming states not otherwise associated with credits or prizes. collectively called savable game state or savable game state. The savable game states may be saved on a game voucher or any other media-based implementation or may be saved in strictly softcopy (electronic or other means) from. Any savable game state, in whatever form it is stored, comprises savable game state. The saving of game states provides for the promotion of continued play in a gaming environment.

A player may restore award credits and/or other game state from previously played games when the previously played games are the same game device or from a similarly constructed game or any game with equivalent results or states. For example, saving the bonus game state of "Froggie" in FIG. 12 results in a voucher (or other instrument, or data in a database) that may then be used in any game where the secondary bonus game is triggered by the primary game with the same probability (pay tables establishing the same likelihood of incrementing the secondary or bonus game) coupled with a bonus that game that has 9 incremental states to win.

Although the description above contains much specificity, the description should not be construed as limiting the scope of the invention but as merely providing an illustration of the presently preferred embodiment of the invention. The scope of this invention should be determined by the appended claims and their legal equivalents.

What is claimed is:

1. A gaming system comprising:

at least one gaming device configured to allow a player to play at least one primary game involving wagering and at least one secondary game, said primary game being a game whose outcome is based on chance and said secondary game playable by a player upon the occurrence of a pre-defined event in said primary game, said gaming device further configured to issue game state data upon a request event where said issued game state data comprises data corresponding to said secondary game's state when said game state data is issued and where said issued data comprises data that corresponds to other than: game play credits; a base state; a win state; or, a visible award credit count, and further configured to accept applicable game state data, and further configured to set said at least one secondary game in accordance with said applicable game state data;

at least one input device operably disposed within said at least one gaming device, configured to receive game state data and to communicate said received game state data to said gaming device; and, at least one output device configured to produce game state data output based on said issued game state data, in a form receivable by a player and readable by said input device.

2. A game device configured to allow at least one player to play at least one primary game involving wagering and at least one secondary game, said primary game being a game whose outcome is based on chance and said secondary game playable by a player upon the occurrence of a pre-defined event in said primary game, comprising:

a game state manager operably disposed within said game device and in communication with said at least one secondary game, configured to receive game state data from said at least one secondary game and set game state in said at least one secondary game, where said game state comprises data corresponding to said secondary game's state when said game state data is received and where said received data comprises data that corresponds to other than: game play credits; a win state; a base state; or, a visible award credit count;

an input device in operable communication with said game state manager, said game state manager configured to receive game state data from said input device; and, an output device in operable communication with said game state manager, said game state manager configured to output game state data to said output device.

3. The game device of claim 2 where said input device and said game state manager are further configured to receive vouchers having game state data comprising game state data for one of: a plurality of games; a plurality game states; or, a plurality of games and a plurality of game states.

4. The game device of claim 2 further comprising a network interface device configured to operably send and receive game state data over a LAN.

5. The game device of claim 4 where said input device is further configured to receive a player ID and said game state manager is further configured to retrieve any game state data from a database over a LAN, where said retrievable game state data is correlated with said player ID.

6. The game device of claim 4 where said game state manager is configured to output game state data to a database over a LAN using said network interface device, where said game state data is correlated with a player ID.

7. The game device of claim 2 where said game state manager is configured to set said at least one game in accordance with game state data received from one of: said input device; said network interface device; or, said input device and said network interface device.

8. The game device of claim 2 where said game state manager is configured to send game state data from said at least one game to said output device in accordance with said at least one game.

9. The game device of claim 2 where said input device and said output device are implemented in the same physical device.

10. A method for maintaining game state of a game device, said game device involving wagering and having at least one primary game and at least one secondary game, said primary game being a game whose outcome is based on chance and said secondary game playable by a player upon the occurrence of a pre-defined event in said primary game, and configured to issue a voucher upon one of: winning game event, or, a player input to print a voucher, the method comprising:

providing at least one game state in said secondary game different than a base state and different than a win state; and, issuing a voucher receivable by a player where said voucher has thereon machine readable indicia comprising data corresponding to said secondary game's state when said game state data is issued and where said issued game state data comprises data that is more than: game play credits; or, a visible award credit count, when one of: a winning event, or a player input to print a voucher occurs.

11. A method for maintaining game state of a game device, said game device involving wagering and having at least one primary game and at least one secondary game, said secondary game configured to have settable game state, the method comprising:

providing at least one game state in said secondary game different than a base state and different than a win state; and, sending electronic data comprising data corresponding to said secondary game's state when said game state data is sent and where said sent game state data comprises data that is more than: game play credits; or, a visible award credit count, over a LAN in receivable by a database.

12. The method of 11 further comprising associating a player with said game state.

13. A method for retrieving game state of a game device, the game device involving wagering and having at least one primary game and at least one secondary game, and further configured to accept a voucher having thereon machine readable indicia of game state, the method comprising:

providing at least one game state in said secondary game different than a base state and different than a win state and different than either of: changes to a game play credit count; or, a visible award credit count;

reading a voucher having machine readable indicia of game state thereon;

applying said game state to said game device; and, configuring said game device in accordance with said game state and viewable by a player.

14. A method for retrieving game state for a game device, the game device involving wagering and having at least one primary game and at least one secondary game, and further configured to accept electronic signals over a LAN having game state therein, the method comprising:

providing at least one game state in said secondary game different than a base state and different than a win state and different than either of: changes to a game play credit count; or, a visible award credit count;

decoding said game state in said electronic signals; and, configuring said game device in accordance with said game state and viewable to a player.

15. The method of 14 further comprising:

accepting player ID; and, receiving electronic data comprising game state associated with said player ID.

16. A method of using savable game state by a player in a game device, the game device involving wagering and having at least one primary game and at least one secondary game, and further configured to accept input and issue output in accordance with game state, the method comprising:

providing at least one game state in said secondary game different than a base state and different that a win state and different than either of: changes to a game play credit count; or, a visible award credit count;

accepting input containing game state provided by said player;

processing said game state in accordance with said game device and input from said player; and, issuing output in accordance with said processing by said game device and said player.

17. The method of claim 16 where said input according to said player comprises a voucher, and said issued output is a voucher receivable by said player.

18. The method of claim 16 where said input according to said player is a player ID, the method further comprising:

accepting said player ID;

retrieving game state associated with said player ID in an electronic form over a LAN; and, issuing output in an electronic form over a LAN, containing therein game state configured to be associated with said player ID.

* * * * *

UNITED STATES PATENT AND TRADEMARK OFFICE

CERTIFICATE OF CORRECTION

PATENT NO. : 6,758,757 B2
APPLICATION NO. : 09/788168
DATED : July 6, 2004
INVENTOR(S) : Luciano, Jr. et al.

It is certified that error appears in the above-identified patent and that said Letters Patent is hereby corrected as shown below:

On the title page secion (63) line 1, replace “Continuation” with --Continuation-in-part--

Signed and Sealed this

Sixth Day of March, 2007

JON W. DUDAS
*Director of the United States Patent and Trademark Office*